US007714495B2

(12) United States Patent
Yoo et al.

(10) Patent No.: US 7,714,495 B2
(45) Date of Patent: May 11, 2010

(54) ELECTRON EMISSION DISPLAY HAVING AN OPTICALLY TRANSMISSIVE ANODE ELECTRODE

(75) Inventors: Seung-Joon Yoo, Yongin-si (KR); Su-Kyung Lee, Yongin-si (KR); Won-Il Lee, Yongin-si (KR); Cheol-Hyeon Chang, Yongin-si (KR); Zin-Min Park, Yongin-si (KR); Jung-Ho Kang, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 554 days.

(21) Appl. No.: 11/583,405

(22) Filed: Oct. 18, 2006

(65) Prior Publication Data

US 2007/0138937 A1 Jun. 21, 2007

(30) Foreign Application Priority Data

Oct. 31, 2005 (KR) ..... 10-2005-0103525

(51) Int. Cl.

| | |
|---|---|
| ***H01J 1/46*** | (2006.01) |
| ***H01J 19/06*** | (2006.01) |
| ***H01J 1/62*** | (2006.01) |
| ***H01J 63/04*** | (2006.01) |

(52) U.S. Cl. ..... 313/495; 313/497; 313/311; 313/293; 313/496; 313/306

(58) Field of Classification Search ..... None
See application file for complete search history.

(56) References Cited

U.S. PATENT DOCUMENTS

| | | | | |
|---|---|---|---|---|
| 5,643,033 | A | 7/1997 | Gnade et al. | |
| 6,124,671 | A | 9/2000 | Fushimi et al. | |
| 6,255,773 | B1 | 7/2001 | Powers et al. | |
| 7,095,169 | B2 * | 8/2006 | Ohishi et al. | 313/495 |
| 2004/0135493 | A1 * | 7/2004 | Park et al. | 313/497 |
| 2005/0116610 | A1 * | 6/2005 | Jung et al. | 313/495 |

FOREIGN PATENT DOCUMENTS

| | | | |
|---|---|---|---|
| GB | 2 399 217 | A | 9/2004 |

(Continued)

OTHER PUBLICATIONS

English translation of JP 2002-124199 (Kida et al).*

(Continued)

*Primary Examiner*—Nimeshkumar D Patel
*Assistant Examiner*—Natalie K Walford
(74) *Attorney, Agent, or Firm*—Christie, Parker & Hale, LLP

(57) ABSTRACT

An electron emission display includes first and second substrates facing each other, a plurality of election emission regions provided on the first substrate, a black layer formed on a first surface of the second substrate between the phosphor layers, and an anode electrode coupled to the phosphor and black layers. The anode electrode has a light transmissivity ranging from about 3% to about 15%. A method of forming the anode electrode includes forming an interlayer on the phosphor and black layer, depositing a conductive material on the second substrate, and removing the interlayer through a firing process.

18 Claims, 3 Drawing Sheets

FOREIGN PATENT DOCUMENTS

| | | |
|---|---|---|
| JP | 03-261032 | 11/1991 |
| JP | 05-217496 | 8/1993 |
| JP | 06-223736 | 8/1994 |
| JP | 2001-291469 | 10/2001 |
| JP | 2002-124199 | 4/2002 |
| JP | 2003-045321 | 2/2003 |
| JP | 2005-302326 | 10/2005 |

OTHER PUBLICATIONS

Patent Abstracts of Japan, Publication Number: 2002-124199; Publication Date: Apr. 26, 2002; in the name of Shinjiro Kida et al.

Search Report dated May 15, 2007 for corresponding European Patent Application No. 06122551.2-2208.

Krujatz, J., et al., *Herstellung von Spiegelschichtsystemen auf der Basis vaon Aluminum oder Silber für den Einsatz in der Mikrosystemtechnik*, Technischen Universität Chemnitz, Jan. 16, 2003, http://archiv.tu-chemnitz/pub/2003/0022, 2 pages.

Chinese Office action dated Mar. 27, 2009, for corresponding Chinese application 200610137629.6, with English translation noting listed references in this IDS, as well as Japan reference JP 2002-124199, and U.S. Reference 6,255,773 previously filed in an IDS dated Aug. 8, 2007.

* cited by examiner

ELECTRON EMISSION DISPLAY HAVING AN OPTICALLY TRANSMISSIVE ANODE ELECTRODE

CROSS-REFERENCE TO RELATED APPLICATION

This application claims priority to and the benefit of Korean Patent Application No. 10-2005-0103525, filed on Oct. 31, 2005, in the Korean Intellectual Property Office, the entire content of which is incorporated herein by reference.

BACKGROUND OF THE INVENTION

1. Field of the Invention

The present invention relates to an electron emission display, and more particularly, to an electron emission display having an anode electrode which is coupled to a phosphor layer to receive a high voltage required for accelerating electron beams.

2. Description of Related Art

Generally, electron emission elements can be classified into those using hot cathodes as an electron emission source, and those using cold cathodes as the electron emission source.

There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

The electron emission elements are arrayed on a first substrate to form an electron emission device. A light emission unit having phosphor layers and an anode electrode is formed on a second substrate. The electron emission device, the second substrate, and the light emission unit establish an electron emission display.

In the electron emission display, there is provided an anode electrode for directing the electrons emitted from the first substrate. The anode electrode receives a high voltage required to accelerate the electron beams, thereby reducing the extent to which the surface of the phosphor layer is charged by the electrons.

The anode electrode is formed of a transparent conductive material such as indium tin oxide (ITO) or a metallic material such as aluminum. The anode electrode is coupled to the phosphor layers facing the first substrate. The anode electrode functions to heighten the screen luminance by receiving a high voltage required to accelerate the electron beams and by reflecting the visible rays radiated from the phosphor layers to the first substrate back toward the second substrate.

The anode electrode is formed by (1) forming an interlayer formed of a polymer material that will be vaporized during a firing process; (2) depositing a conductive material, for example, aluminum, on the interlayer; and (3) removing the interlayer by vaporizing the interlayer material through fine pores of the conductive material.

The yield and performance of the anode electrode are greatly affected by a deposition thickness of the conductive material, a distance between the anode electrode and the phosphor layer, a distribution of fine pores in the conductive material, and other similar factors. For example, if the anode electrode lacks a proper distribution of fine pores (e.g., has a relatively low density of the fine pores), it may be easily damaged during the firing process for removing the interlayer, and the light reflective efficiency may be reduced.

That is, if the anode electrode is too densely deposited to have the proper distribution of fine pores, the interlayer material cannot be completely vaporized through the fine pores during the firing process, thereby causing the anode electrode to swell.

As a result, a portion of the anode electrode peels off. The damaged portion of the anode electrode cannot properly accelerate the electron beam from the first substrate, and thus the light emission efficiency of the phosphor layer corresponding to the damaged portion of the anode electrode is reduced.

By contrast, when the density of the fine pores is too high, the light reflective efficiency of the anode electrode is lowered such that the luminance of the image deteriorates.

SUMMARY OF THE INVENTION

An aspect of the present invention provides an electron emission display that can improve the luminance of an image by reducing the damage to an anode electrode during a firing process for vaporizing an interlayer, and by enhancing a light reflective efficiency of the anode electrode.

According to an exemplary embodiment of the present invention, there is provided an electron emission display including: a first substrate, a second substrate facing the first substrate; a plurality of electron emission regions provided on the first substrate; a plurality of phosphor layers formed on a first surface of the second substrate; a black layer formed on the first surface of the second substrate between at least two of the phosphor layers; and an anode electrode coupled to the phosphor and black layers, wherein the anode electrode has a light transmissivity ranging from about 3% to about 15%.

The anode electrode may contact the black layer and may be spaced apart from the phosphor layers by a distance (which may be predetermined) therebetween.

The distance may be within a range from about 3 μm to about 6 μm.

The electron emission display may further include a plurality of cathode electrodes formed on the first substrate; an insulation layer formed on the first substrate and covering the cathode electrodes; and a plurality of gate electrodes formed on the insulation layer, wherein the electron emission regions are electrically connected to the cathode electrodes.

The electron emission display may further include a focusing electrode disposed above and insulated from the cathode and gate electrodes.

The electron emission display may further include: a first electrode formed on the first substrate, a second electrode formed on the first substrate and spaced apart from the first electrode; a first conductive layer formed on the first substrate and partly covering surfaces of the first electrode, and a second conductive layer formed on the first substrate and partly covering surfaces of the second electrode, wherein at least one of the electron emission regions is formed between the first and second conductive layers.

The electron emission regions may be formed of a material selected from the group consisting of carbon nanotubes, graphite, graphite nanofibers, diamonds, diamond like carbon, $C_{60}$, silicon nanowires, and combinations thereof.

According to another exemplary embodiment of the present invention, there is provided a method of manufacturing an electron emission display, including: forming phosphor and black layers on a substrate; forming an interlayer on the phosphor and black layers; removing a portion of the interlayer that corresponds to the black layers; depositing a conductive material for an anode electrode on the substrate; and removing the interlayer through a firing process.

A light transmissivity of the anode electrode may be adjusted varying a thickness and/or a roughness of the interlayer.

The light transmissivity of the anode electrode may be within a range from about 3% to about 15%.

The interlayer may be formed to have a thickness within a range from about 3 μm to about 6 μm such that, when the interlayer is removed through the firing process, a distance between the anode electrode and the phosphor layers is within the range from about 3 μm to about 6 μm.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
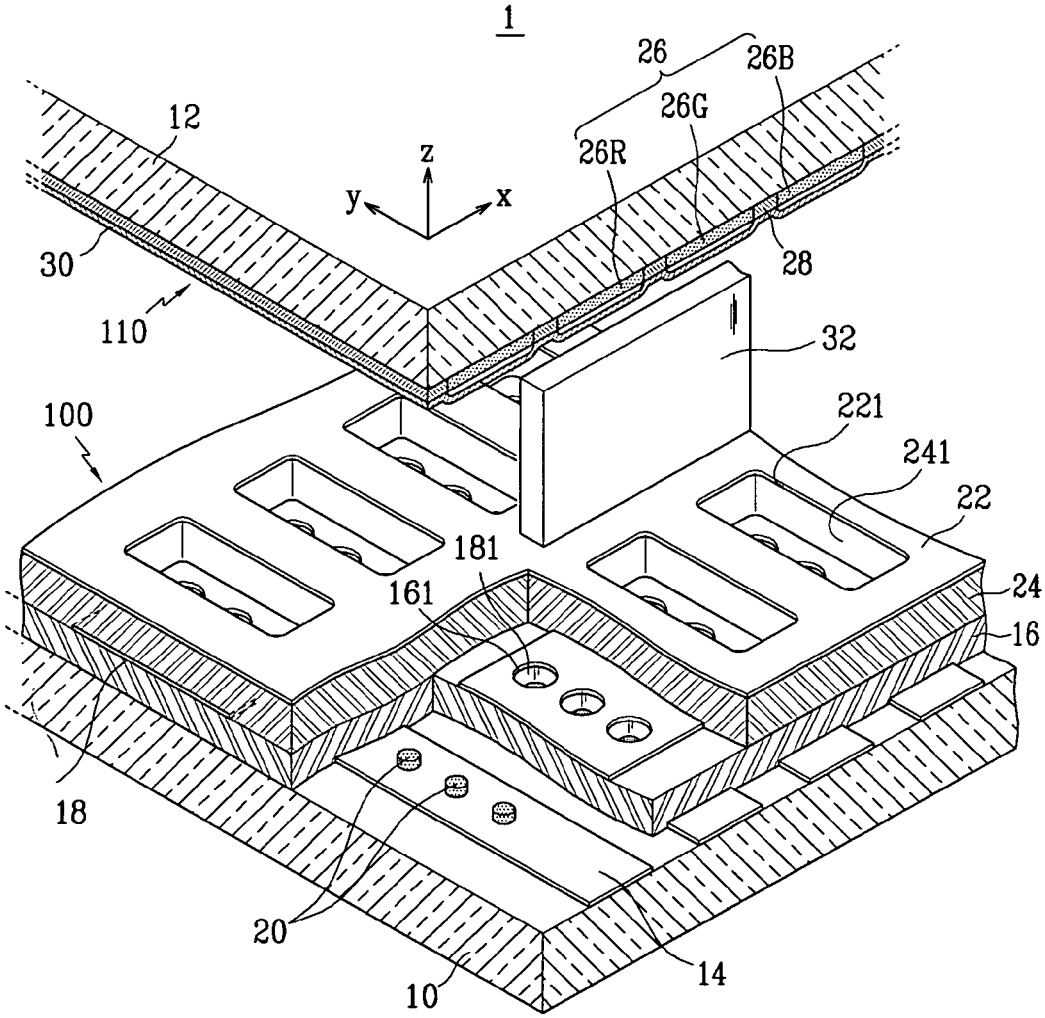
FIG. 1 is a partial exploded perspective view of an electron emission display according an embodiment of the present invention.
Figure 2:
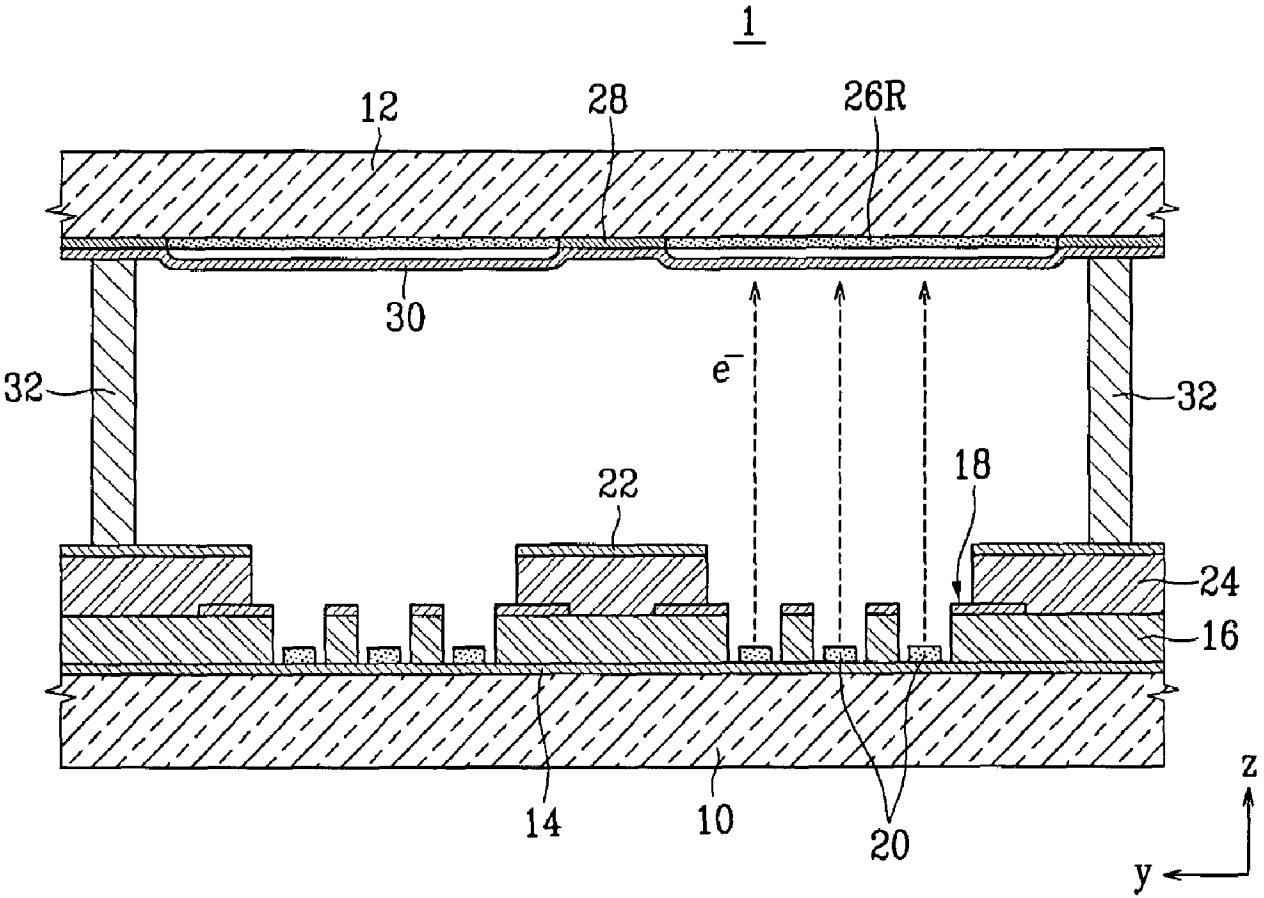
FIG. 2 is a partial sectional view of the electron emission display of FIG. 1.
Figure 3:
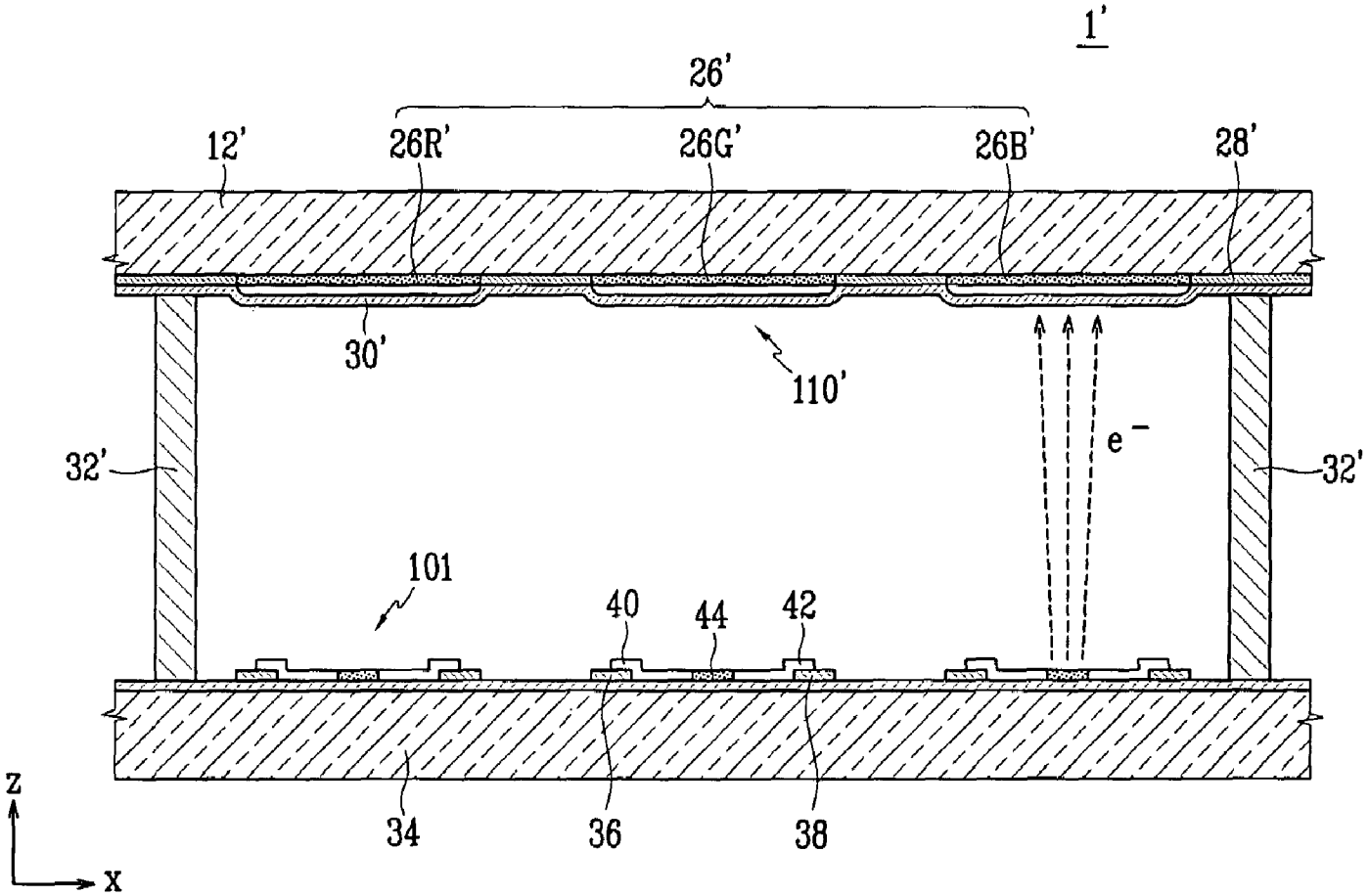
FIG. 3 is a partial sectional view of an electron emission display according to another embodiment of the present invention.

FIGS. 1 through 3 show an electron emission display 1 according to an embodiment of the present invention. In this exemplary embodiment, the electron emission display 1 having an array of FEA elements is illustrated.

Referring to FIGS. 1 and 2, the electron emission display 1 includes first and second substrates 10 and 12 facing each other with a distance (which may be predetermined) therebetween. A sealing member (not shown) is provided at the peripheries of the first and second substrates 10 and 12 to seal them together. The space defined by the first and second substrates and the sealing member is exhausted to form a vacuum envelope (or vacuum chamber) kept to a degree of vacuum of about $10^{-6}$ Torr.

A plurality of electron emission elements are arrayed on the first substrate 10 to form an electron emission device 100. The electron emission device 100 is combined with a light emission unit 110 provided on the second substrate 12 to form the electron emission display 1.

A plurality of cathode electrodes (first driving electrodes) 14 are arranged on the first substrate 10 in a stripe pattern extending along a first direction, and a first insulation layer 16 is formed on the first substrate 10 to cover the cathode electrodes 14. A plurality of gate electrodes (second driving electrodes) 18 are formed on the first insulation layer 16 in a stripe pattern extending along a second direction crossing the first direction at a right angle.

Each crossed area of the cathode and gate electrodes 14 and 18 defines a unit pixel (or pixel unit). One or more electron emission regions 20 are formed on the cathode electrode 14 at each unit pixel. Openings 161 and 181 corresponding to the electron emission regions 20 are formed on the first insulation layer 16 and the gate electrodes 18 to expose the electron emission regions 20.

The electron emission regions 20 may be formed of a material which emits electrons when an electric field is applied thereto under a vacuum atmosphere, such as a carbonaceous material and/or a nanometer-sized material. For example, the electron emission regions 20 may be formed of carbon nanotubes, graphite, graphite nanofibers, diamonds, diamond-like carbon, $C_{60}$, silicon nanowires, or combinations thereof. Alternatively, the electron emission regions 20 may be formed as a molybdenum-based or silicon-based pointed-tip structure.

In the foregoing description, the gate electrodes 18 are arranged above the cathode electrodes 14 with the first insulation layer 16 interposed therebetween, but the invention is not limited to this case. That is, the gate electrodes may be disposed under the cathode electrodes with the first insulation layer interposed therebetween. In this case, the electron emission regions may be formed on sidewalls of the cathode electrodes on the first insulation layer.

A second insulation layer 24 is formed on the first insulation layer 16 covering the gate electrodes 18, and a focusing electrode 22 is formed on the second insulation layer 24. The gate electrodes 18 are insulated from the focusing electrode 22 by the second insulation layer 24. Openings 221 and 241 through which electron beams pass are formed through the second insulation layer 24 and the focusing electrode 22. Each one of the openings 221 of the focusing electrode 22 is formed to correspond to one unit pixel to generally focus the electrons emitted from one unit pixel.

Phosphor layers 26 such as red, green and blue phosphor layers 26R, 26G and 26B are formed on a surface of the second substrate 12 facing the first substrate 10, and black layers 28 for enhancing the contrast of the screen are arranged between the phosphor layers 26 (e.g., a black layer 28 is formed between at least two of the phosphor layers 26). The phosphor layers 26 may be formed to correspond to the respective unit pixels defined on the first substrate 10.

An anode electrode 30 formed of a conductive material such as aluminum is coupled to the phosphor and black layers 26 and 28. The anode electrode 30 functions to heighten the screen luminance by receiving a high voltage required to accelerate the electron beams and by reflecting the visible rays radiated from the phosphor layers 26 to the first substrate 10 back toward the second substrate 12.

Alternatively, the anode electrode 30 can be formed of a transparent conductive material, such as Indium Tin Oxide (ITO), instead of the metallic material. In this case, the anode electrode 30 is placed on the second substrate 12, and the phosphor and black layers 26 and 28 are formed on the anode electrode 30. Alternatively, the anode electrode 30 may include a transparent conductive layer and a metallic layer.

The anode electrode 30 has a light transmissivity within a range (which may be predetermined) defined by the distribution of fine pores dispersed in the anode electrode 30. When the distribution of the fine pores is represented as the light transmissivity, the anode electrode 30 of this embodiment is designed to have a light transmissivity within a range from about 3% to about 15%.

When the transmissivity of the anode electrode 30 is less than 3%, an interlayer material used in a process for forming the anode electrode 30 may not be effectively vaporized. In order to form the anode electrode 30, an interlayer is formed on the phosphor layers 26, and the anode electrode 30 is formed by depositing a conductive material, such as aluminum, on the interlayer. Then, a firing process is performed to remove the interlayer by vaporizing the interlayer. At this point, if the transmissivity of the anode electrode 30 is less than 3%, the interlayer layer material is not effectively vaporized. As a result, a portion of the anode electrode 30 may swell out and peel off, and the anode electrode 30 may be damaged.

In addition, a medium voltage of about 5 kV is applied to the anode electrode 30. Therefore, when the light transmissivity of the anode electrode 30 is less than 3%, the damaged portion of the anode electrode 30 cannot properly accelerate the electron beam from the first substrate 10. Thus, an amount of electrons reaching the phosphor layer 26 is reduced, thereby deteriorating the luminance of the image. On the other hand, when the light transmissivity of the anode electrode 30 is greater than 15%, the light reflective efficiency of the anode electrode 30 is lowered, thereby deteriorating the luminance of the image.

Therefore, the distribution of the fine pores in the anode electrode 30 is chosen to provide a range from 3% to 15% light transmissivity to the anode electrode 30. This distribution of fine pores reduces damage to the anode electrode 30 and allows a sufficient amount of the electrons to reach the phosphor layer 26 while increasing the light reflective efficiency of the anode electrode 30. Therefore, the luminance of the image can be enhanced.

In this embodiment, the anode electrode 30 is arranged such that it contacts the black layer(s) 28 and is spaced apart from the phosphor layers 26 by a distance (which may be predetermined) within a range from about 3 μl to about 6 μm. Therefore, the bonding force of the anode electrode 30 to the second substrate 12 increases by the contact with the black layer(s) 28. In addition, when the anode electrode 30 is spaced apart from the phosphor layers 26, it can obtain a sufficient flatness without being affected by a surface roughness of the phosphor layers 26, thereby maximizing the light reflective efficiency.

The above-described anode electrode 30 can be formed by (1) forming an interlayer on the phosphor and black layers 26 and 28; (2) removing a portion of the interlayer corresponding to the black layer 28; (3) depositing a conductive material, such as aluminum, on the entire surface of the second substrate 12; and (4) removing the rest of the interlayer through a firing process. A photoresistant material can be used as the interlayer. The light transmissivity of the anode electrode 30 can be effectively adjusted by varying a thickness and/or a surface roughness of the interlayer.

Disposed between the first and second substrates 10 and 12 are spacers 32 for uniformly maintaining a gap between the first and second substrates 10 and 12. The spacers 32 are arranged corresponding to the black layer(s) 28 so that the spacers 32 do not obstruct the phosphor layers 26.

The above-described electron emission display is driven when a voltage (which may be predetermined) is applied to the cathode, gate, focusing, and anode electrodes 14, 18, 22, and 30.

For example, the cathode electrodes 14 may serve as scanning electrodes receiving a scanning drive voltage, and the gate electrodes 18 may function as data electrodes receiving a data drive voltage (or vise versa). The focusing electrode 22 receives a voltage for focusing the electron beams, for example, 0V or a negative direct current voltage ranging from several to several tens of volts. The anode electrode 30 receives a voltage for accelerating the electron beams, for example, a positive direct current voltage ranging from hundreds through thousands of volts.

Electric fields are formed around the electron emission regions 20 at unit pixels where a voltage difference between the cathode and gate electrodes 14 and 18 is equal to or higher than a threshold value and thus the electrons are emitted from the electron emission regions 20. The emitted electrons are attracted to the corresponding phosphor layers 26 by the high voltage applied to the anode electrode 30, and the electrons strike the phosphor layers 26, thereby exciting the phosphor layers 26 to emit light.

During the above-described driving operation by the anode electrode 30 having the above-described light transmissivity, the light reflective efficiency of the anode electrode 30 increases while a sufficient amount of electrons lands on the phosphor layers 26, thereby realizing a high luminance image. In addition, the anode electrode 30 is stable against the high voltage.

FIG. 3 shows an electron emission display 1' according to another embodiment of the present invention. In this exemplary embodiment, the electron emission display 1' having an array of SCE elements is illustrated.

First and second electrodes 36 and 38 are arranged on a first substrate 34 and spaced apart from each other. Electron emission regions 44 are formed between the first and second electrodes 36 and 38. First and second conductive layers 40 and 42 are formed on the first substrate 34 between the first electrode 36 and the electron emission region 44, and between the electron emission region 44 and the second electrode 38, respectively. The first and second conductive layers 40 and 42 partly cover the first and second electrodes 36 and 38. The first and second electrodes 36 and 38 are electrically connected to the electron emission region 44 by the first and second conductive layers 40 and 42.

In this embodiment, the first and second electrodes 36 and 38 may be formed of a variety of conductive materials. The first and second conductive layers 40 and 42 may be particle-thin film formed of a conductive material such as nickel, gold, platinum, or palladium.

The electron emission regions 44 may be formed of graphite carbon and/or carbon compound. For example, the electron emission regions 44 may be formed of a material selected from the group consisting of carbon nanotubes, graphite, graphite nanofibers, diamonds, diamond-like carbon, fullerene ($C_{60}$), silicon nanowires, and combinations thereof.

When voltages are applied to the first and second electrodes 36 and 38, current flows in a direction parallel with surfaces of the electron emission regions 44 through the first and second conductive layers 40 and 42 to realize the surface conduction electron emission. The emitted electrons are attracted to phosphor layers 26' (with black layers 28' therebetween) by a high voltage applied to an anode electrode 30' at a second substrate 12', and strike and excite the corresponding phosphor layers 26' formed on the second substrate 12'.

Although the electron emission displays 1 and 1' having FEA elements and SCE elements are described in the above exemplary embodiments, the present invention is not limited to these examples. That is, the present invention may be applied to an electron emission display having other types of electron emission elements, such as MIM elements and MIS elements.

According to embodiments of the present invention, by providing the anode electrode with a light transmissivity within the above-described range, the interlayer material can be effectively vaporized during the interlayer firing process. As a result, damage to the anode electrode can be reduced or prevented. Furthermore, the electron beam transmissivity and the light reflective efficiency can be increased.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display comprising:

a first substrate;

a second substrate facing the first substrate;

a plurality of electron emission regions provided on the first substrate;

a plurality of phosphor layers formed on a first surface of the second substrate;

a black layer formed on the first surface of the second substrate between at least two of the phosphor layers; and an anode electrode coupled to the phosphor and black layers, wherein the anode electrode has pores that provide a light transmissivity ranging from about 3% to about 15%.

2. The electron emission display of claim 1, wherein the anode electrode contacts the black layer and is spaced apart from the phosphor layers by a distance therebetween.

3. The electron emission display of claim 2, wherein the distance therebetween is within a range from about 3 μm to about 6 μm.

4. The electron emission display of claim 1, wherein the anode electrode is formed of a metallic material.

5. The electron emission display of claim 1, further comprising:

a plurality of cathode electrodes formed on the first substrate;

an insulation layer formed on the first substrate and covering the cathode electrodes; and a plurality of gate electrodes formed on the insulation layer, wherein the electron emission regions are electrically connected to the cathode electrodes.

6. The electron emission display of claim 5, further comprising a focusing electrode disposed above and insulated from the cathode and gate electrodes.

7. The electron emission display of claim 5, wherein the electron emission regions comprise a material selected from the group consisting of carbon nanotubes, graphite, graphite nanofibers, diamonds, diamond-like carbon, C60, silicon nanowires, and combinations thereof.

8. The electron emission display of claim 1, further comprising:

a first electrode formed on the first substrate;

a second electrode formed on the first substrate and spaced apart from the first electrode;

a first conductive layer formed on the first substrate and partly covering surfaces of the first electrode; and a second conductive layer formed on the first substrate and partly covering surfaces of the second electrode, wherein at least one of the electron emission regions is formed between the first and second conductive layers.

9. The electron emission display of claim 8, wherein the electron emission regions comprise a material selected from the group consisting of carbon nanotubes, graphite, graphite nanofibers, diamonds, diamond-like carbon, C60, silicon nanowires, and combinations thereof.

10. An electron emission display comprising:

a first substrate;

a second substrate facing the first substrate;

a plurality of phosphor layers formed on the second substrate;

a black layer formed on the second substrate between at least two of the phosphor layers; and an anode electrode coupled to the phosphor and black layers, wherein the anode electrode has pores that provide a light transmissivity ranging from about 3% to about 15%.

11. The electron emission display of claim 10, wherein the anode electrode contacts the black layer and is spaced apart from the phosphor layers by a distance therebetween.

12. The electron emission display of claim 11, wherein the distance therebetween is within a range from about 3 μm to about 6 μm.

13. The electron emission display of claim 10, wherein the anode electrode is formed of a metallic material.

14. The electron emission display of claim 10, further comprising:

a cathode electrode formed on the first substrate;

an insulation layer formed on the first substrate and covering the cathode electrode;

a gate electrode formed on the insulation layer; and an electron emission region electrically connected to the cathode electrode.

15. The electron emission display of claim 14, further comprising a focusing electrode disposed above and insulated from the cathode and gate electrodes.

16. The electron emission display of claim 14, wherein the electron emission regions comprise a material selected from the group consisting of carbon nanotubes, graphite, graphite nanofibers, diamonds, diamond-like carbon, C60, silicon nanowires, and combinations thereof.

17. The electron emission display of claim 10, further comprising:

a first electrode formed on the first substrate;

a second electrode formed on the first substrate and spaced apart from the first electrode;

a first conductive layer formed on the first substrate and partly covering the first electrode;

a second conductive layer formed on the first substrate and partly covering the second electrode; and an electron emission region formed between the first and second conductive layers.

18. The electron emission display of claim 17, wherein the electron emission region comprises a material selected from the group consisting of carbon nanotubes, graphite, graphite nanofibers, diamonds, diamond-like carbon, C60, silicon nanowires, and combinations thereof.

* * * * *